US009810499B1

(12) United States Patent
Silver

(10) Patent No.: US 9,810,499 B1
(45) Date of Patent: Nov. 7, 2017

(54) SAFETY ROUND

(71) Applicant: Safe Tech, Inc., Knoxville, TN (US)

(72) Inventor: H. Steven Silver, Knoxville, TN (US)

(73) Assignee: Safe Tech, Inc., Knoxville, TN (US)

( * ) Notice: Subject to any disclaimer, the term of this patent is extended or adjusted under 35 U.S.C. 154(b) by 0 days.

(21) Appl. No.: 15/273,189

(22) Filed: Sep. 22, 2016

Related U.S. Application Data

(60) Provisional application No. 62/383,063, filed on Sep. 2, 2016.

(51) Int. Cl.
*F41A 17/44* (2006.01)
*F41A 15/14* (2006.01)

(52) U.S. Cl.
CPC ..... *F41A 17/44* (2013.01); *F41A 15/14* (2013.01)

(58) Field of Classification Search
CPC ..... F41A 17/44
USPC ..... 42/1.05, 70.01, 70.11
See application file for complete search history.

(56) References Cited

U.S. PATENT DOCUMENTS

| | | | | |
|---|---|---|---|---|
| 1,292,359 | A | 1/1919 | Nelson | |
| 2,294,822 | A | 9/1942 | Albree | |
| 3,371,440 | A | 3/1968 | Cassell | |
| 3,382,596 | A | 5/1968 | Rockwood | |
| 3,678,609 | A | 7/1972 | Fazio | |
| 4,092,794 | A | 6/1978 | Moren | |
| 4,603,498 | A | 8/1986 | Johnson | |
| 4,776,123 | A | 10/1988 | Ascroft | |
| 4,802,298 | A | 2/1989 | Baugus | |
| 4,819,289 | A | 4/1989 | Gibbs | |
| 4,835,894 | A | 6/1989 | Libassi | |
| 4,965,952 | A | 10/1990 | Miller et al. | |
| 5,097,613 | A * | 3/1992 | Miller | F41A 17/44 42/1.05 |
| 5,416,940 | A | 5/1995 | Bandera | |
| 6,250,008 | B1 | 6/2001 | Silver | |
| 6,470,615 | B1 | 10/2002 | Peterken | |
| 6,785,994 | B2 | 9/2004 | Christiansen | |
| 6,904,634 | B2 | 6/2005 | Smith | |
| 7,637,049 | B1 | 12/2009 | Samson et al. | |
| 8,850,738 | B2 * | 10/2014 | Silver | F41C 27/00 42/1.05 |

(Continued)

*Primary Examiner* — Reginald Tillman, Jr.
(74) *Attorney, Agent, or Firm* — Luedeka Neely Group, PC

(57) ABSTRACT

A firearm safety round configured to function as a safety round for the following firearms: SAR 21—Singapore Assault Rifle-21st Century and M-16 rifle. The safety round includes a cylindrical rear end having a rim, a mid-section adjacent the rear end opposite the rim, the mid-section comprises a truncated cylinder having opposite flat sides, a tab extending outwardly from the mid-section and configured so that when the safety round is received by the firing chamber, the tab will extend out of the firing chamber to visually indicate that the firing chamber of the firearm is free of live ammunition and a cylindrical nose portion extending from the mid-section, opposite from the rear end and longitudinally aligned therewith. When the safety round is installed in the firing chamber of the firearm, one of the flat sides rests on the firing chamber and positions the rim in alignment with the extractor, and the flat sides configure the mid-section so that a largest dimension of the mid-section is smaller than a height of the extraction port of the firearm.

2 Claims, 6 Drawing Sheets

(56) References Cited

U.S. PATENT DOCUMENTS

| | | | |
|---|---|---|---|
| 2009/0199345 | A1 | 8/2009 | Morgan |
| 2011/0283588 | A1 | 11/2011 | Samson et al. |

* cited by examiner

SAFETY ROUND

CROSS REFERENCE TO RELATED APPLICATION

This application claims priority to U.S. Provisional App. 62/383,063, filed Sep. 2, 2016, and entitled SAFETY ROUND, incorporated herein by reference in its entirety.

FIELD

This disclosure relates to the field of firearm safety devices. More particularly, this disclosure relates to a firearm safety round or plug configured to be suitable for use with both the SAR 21—Singapore Assault Rifle-21st Century and the M-16 rifle.

BACKGROUND

Firearm safety plugs are used to occupy the firing chamber of a weapon and provide a visual indication that the chamber is occupied by a safety round. The presence of the safety round in the chamber insures that live ammunition round cannot be in the firing chamber.

When it is desired to load live ammunition in to the firearm, the safety round is ejected from the firearm and a live round is chambered. The user keeps the safety round, such as in a pocket or ammunition pack for later use when it is desired to have a safety round in place.

The disclosure advantageously provides a firearm safety plug configured to be suitable for use with firearms with which conventional safety rounds will not work, such as the SAR 21—Singapore Assault Rifle-21st Century.

These firearms are typically configured to fire a 0.223 cartridge or 5.56×45 mm cartridge. Conventional plugs for 0.223 cartridges and 5.56×45 mm cartridges are not suitable for use with the above-noted firearms, as conventional plugs will not eject instantly from the firing chamber of the above-noted firearms by cycling the firearm.

Safety rounds according to the disclosure also advantageously work with firearms that work with conventional safety rounds, such as the M-16 firearm.

SUMMARY

The above and other needs are met by a firearm safety round configured to function as a safety round for the following firearms: SAR 21—Singapore Assault Rifle-21st Century and M-16 rifle.

The safety round includes a cylindrical rear end having a rim, a mid-section adjacent the rear end opposite the rim, the mid-section comprises a truncated cylinder having opposite flat sides, a tab extending outwardly from the mid-section and configured so that when the safety round is received by the firing chamber, the tab will extend out of the firing chamber to visually indicate that the firing chamber of the firearm is free of live ammunition and a cylindrical nose portion extending from the mid-section, opposite from the rear end and longitudinally aligned therewith.

When the safety round is installed in the firing chamber of the firearm, one of the flat sides rests on the firing chamber and positions the rim in alignment with the extractor, and the flat sides configure the mid-section so that a largest dimension of the mid-section is smaller than a height of the extraction port of the firearm.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
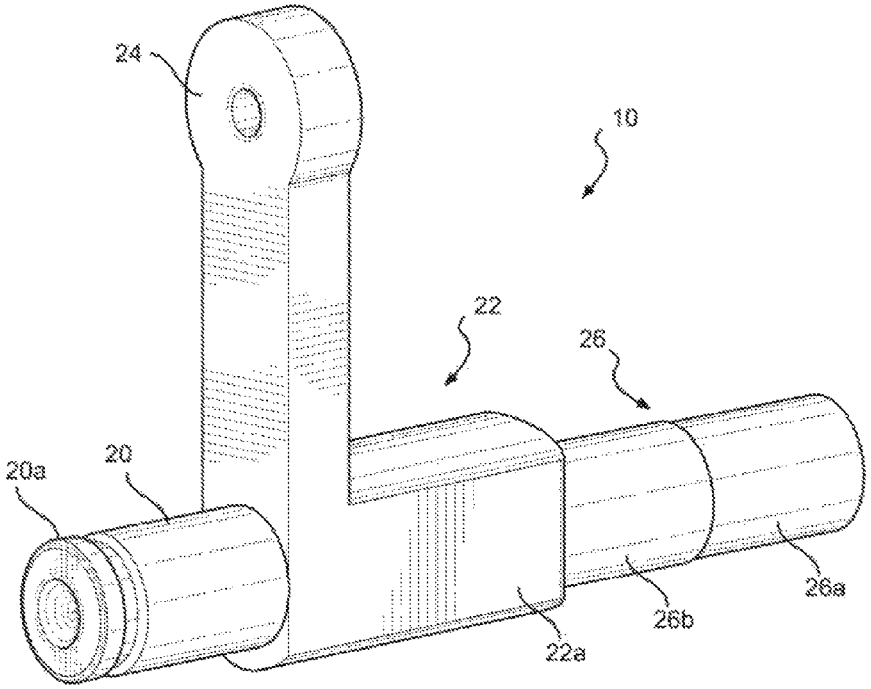
FIGS. 1 and 2 are perspective views of a safety round according to the disclosure.
Figure 2:
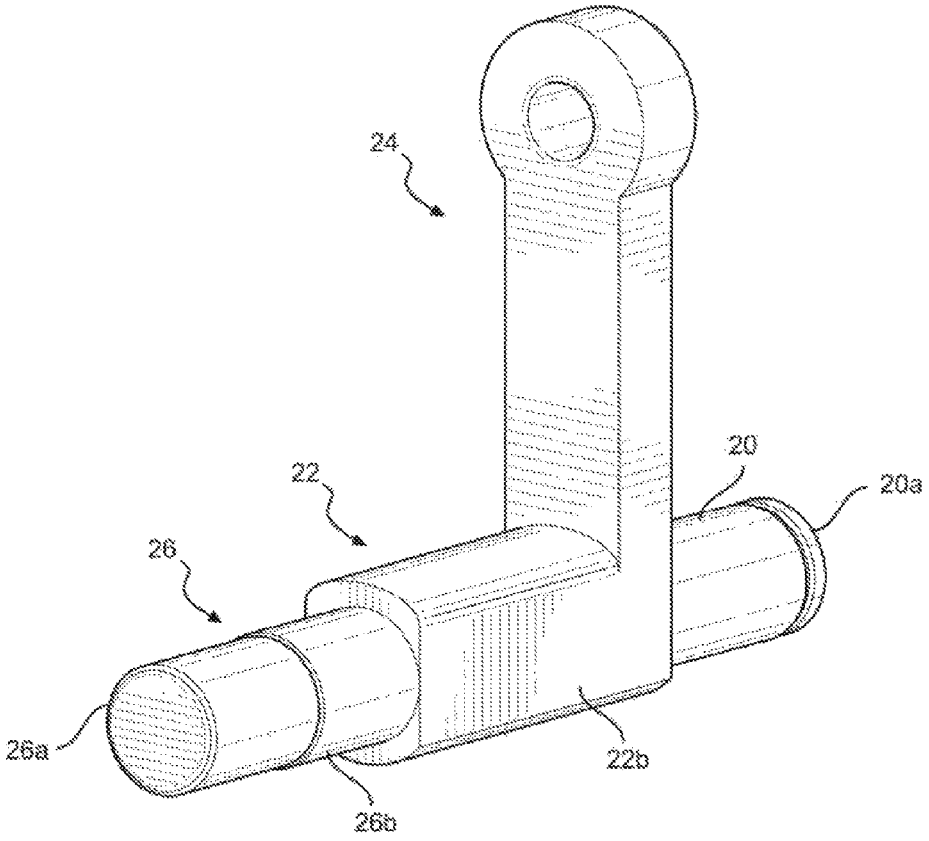
Figure 3:
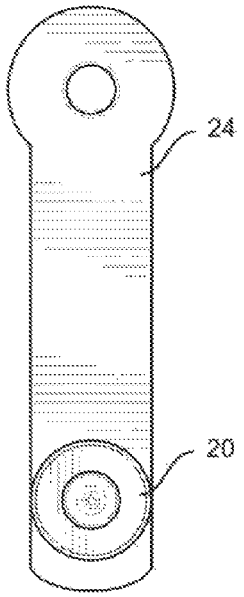
FIG. 3 is a rear end view of the safety round according to the disclosure.
Figure 4:
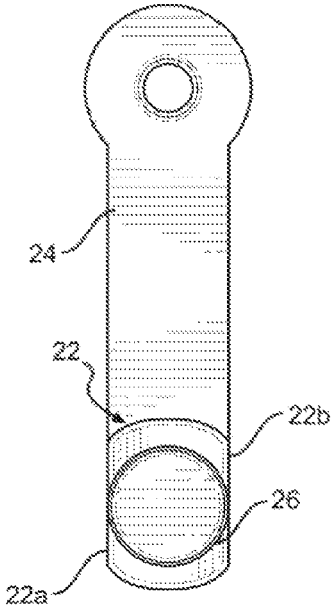
FIG. 4 is a front end view of the safety round according to the disclosure.
Figure 5:
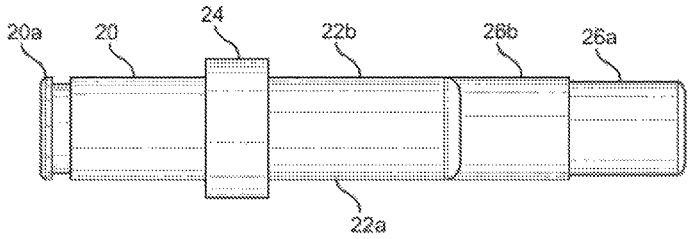
FIG. 5 is a top plan view of the safety round according to the disclosure.
Figure 6:
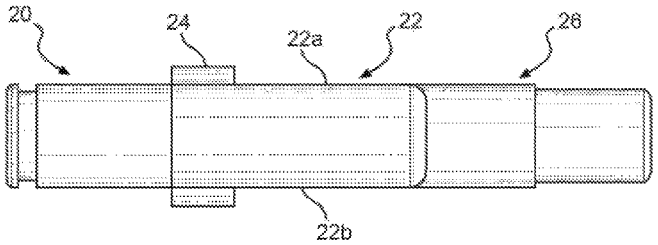
FIG. 6 is a bottom plan view of the safety round according to the disclosure.

With reference to the drawings, the disclosure relates to a firearm safety round 10 configured to be suitable for use with at least the following automatic or semi-automatic firearms: SAR 21—Singapore Assault Rifle-21st Century and, with which conventional safety rounds will not work. The safety round 10 is also compatible with firearms that will work with conventional safety rounds, such as the M-16 and AR-15 rifles. The safety round 10 is also configured to have an aesthetically pleasing appearance.

The plug shown herein is intended for use with the above-noted firearms designed to fire a 0.223 cartridge or 5.56×45 mm cartridge, but is specially configured for use with the aforementioned firearms. Conventional plugs for 0.223 cartridges and 5.56×45 mm cartridges are not suitable for use with the SAR 21—Singapore Assault Rifle-21st Century, as conventional plugs for these cartridges will not eject instantly from the firing chamber of the above-noted firearms by cycling the firearm. Conventional safety rounds will work with the M-16 rifle, the AR-15 rifle, and other such firearms that work with conventional safety rounds The safety round 10 of the present disclosure works with the SAR 21—Singapore Assault Rifle-21st Century, with which conventional safety rounds will not work, and firearms with which conventional safety rounds will work.

The round 10 is configured in one aspect to function as a safety round and is configured to be received within a firing chamber of a firearm in the manner a round of ammunition is positioned or chambered for firing. The safety round 10 is designed to be ejected instantly from the firing chamber of the above noted firearms by cycling the firearm. By so doing the firearm is immediately able to receive live ammunition and is fully functional.

As shown, the safety round 10 is configured as a unitary structure and includes a cylindrical rear end 20 having a rim 20*a*, and a mid-section 22 adjacent the rear end 20. A tab 24 extends outwardly from the mid-section and is configured so that when the safety round 10 is received by the firing chamber and the bolt is closed, the tab 24 will extend to visually indicate that the firing chamber of the firearm is free of live ammunition.

Figure 7:
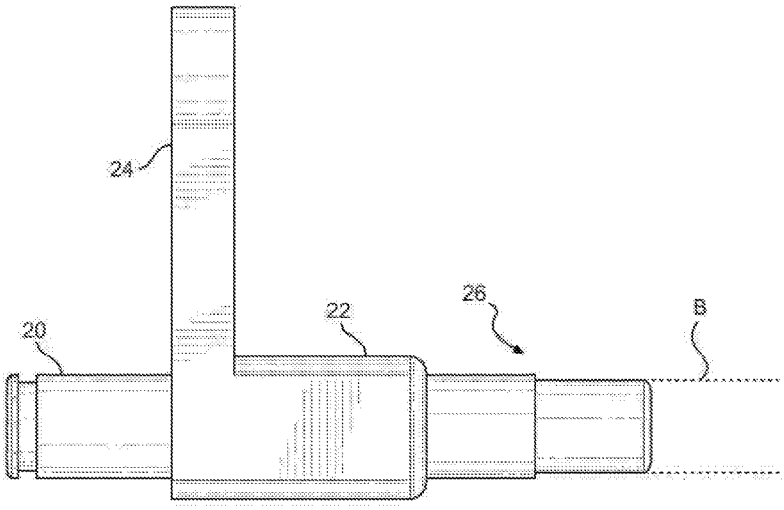
FIG. 7 is a right side view of the safety round according to the disclosure.
Figure 8:
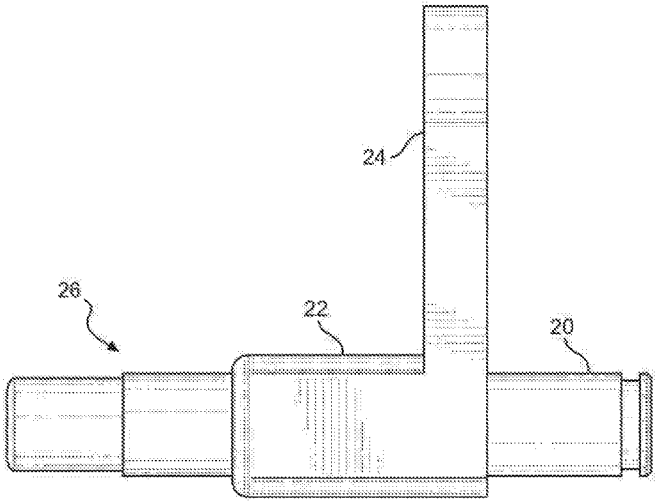
FIG. 8 is a left side view of the safety round according to the disclosure.

A cylindrical nose portion 26 extends from the mid-section 22, opposite from the rear end 20 and longitudinally aligned therewith. The nose portion 26 has a distal portion 26*a* having a diameter smaller than the diameter of a bore B of a barrel of the firearm so as to extend into the bore, and a proximal portion 26*b* having a diameter larger than the diameter of the bore of the firearm so as to abut and not extend into the bore (FIG. 7). The distal portion 26*a* has a length that is sufficiently long to seat in the bore and help ensure that the safety round 10 is longitudinally aligned and parallel with the bore of the firearm when the safety round 10 is installed, yet sufficiently short so that the distal portion 26*a* does not frictionally interact with the bore in such a manner as to hang up or otherwise interfere with immediate ejection of the safety round 10 from the firearm when the firearm is cycled.

The cylindrical rear end 20 is desirably made of brass and the mid-section 22, tab 24, and nose portion 26 are desirably made of melt resistant plastic, preferably a thermoplastic, as by injection molding. The rear end 20 is substantially permanently joined to the mid-section 22 to provide a unitary structure for the safety round 10. The materials are selected to be resistant to melting or deforming when placed in a hot weapon.

If an extractor of the firearm is not able to fully engage the safety round, as occurs with the use of conventional safety rounds in the above noted firearms, the safety round will not function properly.

Figure 9:
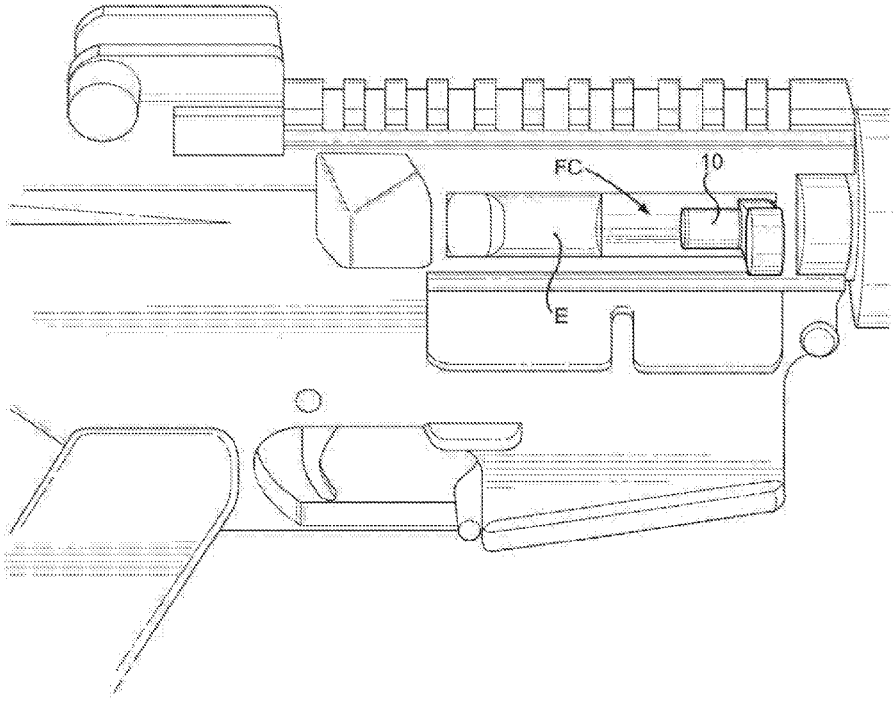
FIG. 9 shows a safety round according to the disclosure being ejected from a firearm.

For example, as shown in FIG. 9, in order for the safety round 10 to function properly in all of the above-noted firearms, an extractor E of the firearm associated with a firing chamber FC of the firearm must engage fully the rim 20*a* of the rear end 20 of the safety round 10. That is, during operation of the firearm, the bolt opens and closes to eject a spent cartridge from the firing chamber FC and to load a new ammunition round into the firing chamber FC. During storage of the firearm, the safety round 10 is placed in the firing chamber FC and the bolt closed, but with the tab 24 extending outwardly to indicate an unloaded condition of the firearm. The rim 20*a* may include a detent or other structure in the location of a primer for receiving a firing pin of the rifle to facilitate dry firing of the rifle if desired.

In addition, a safety round will also not function properly if it hangs up or otherwise interferes with the ejection port during ejection from the firearm. This requires the operator to pull back on the extractor and manually remove the safety round and still have to cycle the firearm before live ammunition can be fired. This defeats the purpose of the safety round in providing instantaneous access to firing capability.

The safety round 10 is configured to be ejected instantly from the firing chamber FC of the above-noted firearms by cycling the bolt of the firearm. By so doing the firearm is immediately able to receive live ammunition and is fully functional. To accomplish this, the safety round 10 is configured so that the extractor E of the above noted firearms strike the rim 20*a* squarely, i.e. straight on and centered. Also, the safety round 10 is configured so as to not hang up or interfere with the ejection port.

To accomplish these objectives, the mid-section 22 is configured so that when the safety round 10 is received within the firing chamber FC of the above-noted firearms, the rim 20*a* is properly aligned with the extractor E. The mid-section 22 is also configured so as to permit the safety round to fit through an ejection port of the firearm associated with the firing chamber FC. Thus, the largest dimension of the mid-section 22 is smaller than the height of the extraction port of the firearm. To satisfy both of these requirements, i.e. proper alignment and extraction diameter, the mid-section 22 is provided as a truncated cylinder in which portions of the cylinder are removed to provide opposite flat sides 22*a* and 22*b*.

When the safety round 10 is installed in the firing chamber FC of the firearm, the flat side 22*a* rests on the firing chamber FC and positions the rim 20*a* in alignment with the extractor E. In combination, the flat sides 22*a* and 22*b* reduce the cross-section of the mid-section so that the largest dimension of the mid-section 22 is smaller than the height of the extraction port of the firearm.

The safety round 10 is configured to overcome the obstacles associated providing a safety round that works in each of the above noted firearms. For the purpose of example, it will be appreciated that the ejection port of the SAR rifle has a maximum dimension of over 12 mm, while the ejection port of the M-16 is about 9 mm. Thus, the truncation provided to the mid-section 22 advantageously results in a safety round that is suitable for use with such different dimensioned firearms.

Accordingly, it will be appreciated that safety rounds configured according to the disclosure are configured to be suitable for use with at least the SAR 21—Singapore Assault Rifle-21st Century, with which conventional safety rounds will not work, as well as firearms with which conventional safety rounds will work, such as the M-16 and the AR-15 rifles.

Safety rounds according to the disclosure are suitable for such use in that such rounds are designed to eject instantly, by having a configuration that enables the ejector E of the firearm to fully engage the safety round, and also not interfere with the ejection port so as to hang up during ejection.

Safety rounds according to the disclosure avoid the need to manufacture many different sizes for a given ammunition, thus reducing costs and problems associated with have an incompatible safety round.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A firearm safety round configured to function as a safety round for firearms of the group comprising the following firearms: SAR 21—Singapore Assault Rifle-21st Century and M-16 rifle, wherein such firearms include a firing chamber adjacent a bore, and an extractor for engaging and ejecting the safety round from the firearm via an ejection port of the firearm by cycling a bolt of the firearm associated with the extractor, with the ejector ports of the firearms varying in size, the safety round comprising:

a cylindrical rear end having a rim;

a mid-section adjacent the rear end opposite the rim, the mid-section comprises a truncated cylinder having a length and opposite flat sides extending the length of the truncated cylinder, the spacing between the flat sides being selected to position the rim to be fully engagable by the extractor, and the flat sides configure the mid-section so that a largest dimension of the mid-section between the flat sides is smaller than a height of the extraction port of the firearm of the group of the firearms that has the smallest sized ejection port of the group;

a tab extending outwardly from the mid-section contiguous with the flat sides and configured so that when the safety round is received by the firing chamber, the tab will extend out of the firing chamber to visually indicate that the firing chamber of the firearm is free of live ammunition; and a cylindrical nose portion extending from the mid-section, opposite from the rear end and longitudinally aligned therewith;

wherein when the safety round is installed in the firing chamber of the firearm, one of the flat sides positions the rim of the safety round in alignment with the extractor so that the rim is positioned to be fully engagable by the extractor so that the safety round is ejectable from the firing chamber by cycling the bolt, and the flat sides configure the mid-section so that a largest dimension of the mid-section between the flat sides is smaller than a height of the extraction port of the firearm of the group of the firearms that has the smallest sized ejection port of the group so that the safety round may be used with all of the firearms despite the firearms having ejection ports of varying size and not hang up during ejection from the firing chamber by cycling the bolt.

2. The safety round of claim 1, wherein the nose portion has a distal portion having a diameter smaller than a diameter of the bore of a barrel of the firearm so as to extend into the bore, and a proximal portion having a diameter larger than the diameter of the bore of the firearm so as to abut and not extend into the bore, wherein the distal portion has a length that is sufficiently long to seat in the bore so that the safety round is longitudinally aligned and parallel with the bore of the firearm when the safety round is installed, yet sufficiently short so that the distal portion does not frictionally interact with the bore in such a manner as to hang up or otherwise interfere with immediate ejection of the safety round from the firearm when the firearm is cycled to eject the safety round from the firing chamber.

* * * * *